US008568656B2

(12) United States Patent
Hu et al.

(10) Patent No.: US 8,568,656 B2
(45) Date of Patent: Oct. 29, 2013

(54) ENVIRONMENT-FRIENDLY MANGANESE BRASS ALLOY AND MANUFACTURING METHOD THEREOF

(75) Inventors: Zhenqing Hu, Xiamen (CN); Chuankai Xu, Xiamen (CN); Qing Lv, Xiamen (CN); Nianrun Zhou, Xiamen (CN); Jia Long, Xiamen (CN); Siqi Zhang, Xiamen (CN)

(73) Assignee: Xiamen Lota International Co., Ltd., Fujian Province (CN)

( * ) Notice: Subject to any disclaimer, the term of this patent is extended or adjusted under 35 U.S.C. 154(b) by 232 days.

(21) Appl. No.: 13/039,152

(22) Filed: Mar. 2, 2011

(65) Prior Publication Data

US 2011/0214836 A1 Sep. 8, 2011

(30) Foreign Application Priority Data

Mar. 2, 2010 (CN) ..... 2010 1 0117783

(51) Int. Cl.

| | |
|---|---|
| ***C22C 9/04*** | (2006.01) |
| ***C22C 9/02*** | (2006.01) |
| ***B22D 7/00*** | (2006.01) |
| ***B22D 11/00*** | (2006.01) |

(52) U.S. Cl.
USPC ..... 420/478; 420/471; 164/476; 164/76.1

(58) Field of Classification Search
USPC ..... 420/469–500; 164/476, 76.1
See application file for complete search history.

(56) References Cited

U.S. PATENT DOCUMENTS

| | | | | |
|---|---|---|---|---|
| 5,653,827 | A * | 8/1997 | Kramer et al. | 148/433 |
| 6,132,528 | A * | 10/2000 | Brauer et al. | 148/434 |
| 7,628,872 | B2 * | 12/2009 | Zhang et al. | 148/434 |
| 2002/0011288 | A1 * | 1/2002 | Mizoguchi et al. | 148/433 |
| 2006/0201591 | A1 * | 9/2006 | Kawahata et al. | 148/553 |
| 2009/0016927 | A1 * | 1/2009 | Oishi | 420/471 |

FOREIGN PATENT DOCUMENTS

| | | | |
|---|---|---|---|
| CN | 1291051 | C | 12/2006 |
| CN | 100441713 | C | 12/2008 |
| CN | 100455685 | C | 1/2009 |
| JP | 61034154 | A * | 2/1986 |
| JP | 2000239765 | A * | 9/2000 |

OTHER PUBLICATIONS

English abstract of JP 61034154 A.*
English abstract of JP 2000239765 A.*
NSF/ANSI Standard 61-2007, "Drinking water system components Health effects" 176 pages.

* cited by examiner

*Primary Examiner* — Kevin P Kerns
*Assistant Examiner* — Steven Ha
(74) *Attorney, Agent, or Firm* — Christie, Parker & Hale, LLP

(57) ABSTRACT

The present invention provides an environment-friendly manganese brass alloy, which comprises 55~65 wt % of Cu, 1.0~6.5 wt % of Mn, 0.2~3.0 wt % of Al, 0~3.0 wt % of Fe, 0.3~2.0 wt % of Sn, 0.01~0.3 wt % of Mg, 0~0.3 wt % of Bi and/or 0~0.2 wt % of Pb, the balance being Zn and unavoidable impurities. The alloys not only have superior mechanical properties, castability, cutability and corrosion resistance, especially stress corrosion resistance properties, but also have the advantages of low manufacturing costs and simple manufacturing process etc, which is suitable for making components through forging, casting, cutting and other manufacturing methods, especially suitable for making water tap bodies and valves through forging, casting and cutting processes.

19 Claims, 1 Drawing Sheet

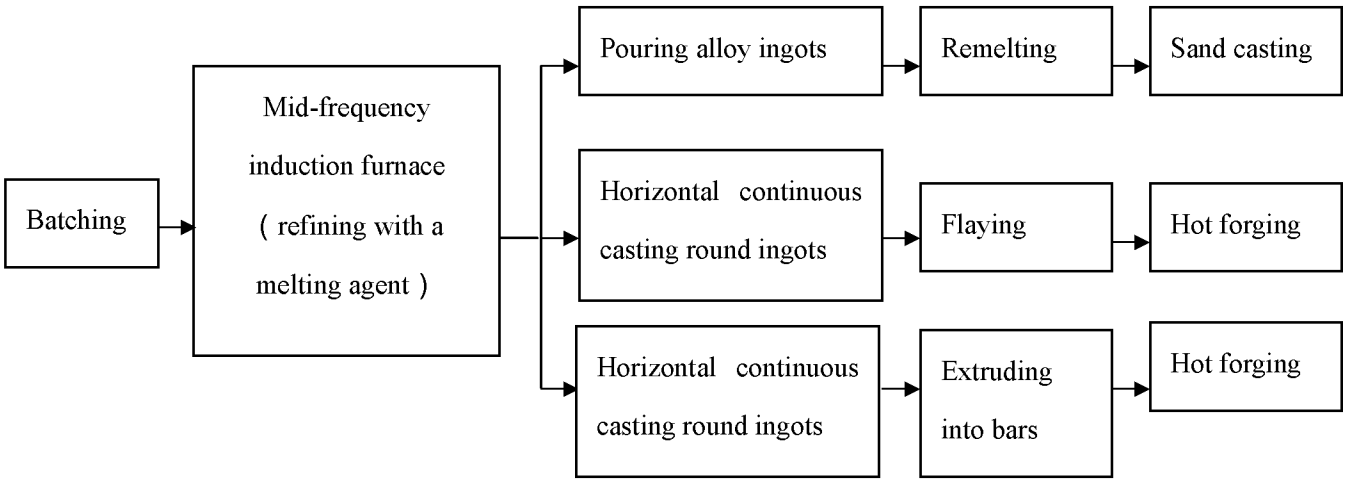
Batching
Mid-frequency induction furnace ( refining with a melting agent )
Pouring alloy ingots
Horizontal continuous casting round ingots
Horizontal continuous casting round ingots
Remelting
Flaying
Extruding into bars
Sand casting
Hot forging
Hot forging

ENVIRONMENT-FRIENDLY MANGANESE BRASS ALLOY AND MANUFACTURING METHOD THEREOF

CROSS-REFERENCE TO RELATED APPLICATION

This application claims priority to and the benefit of Chinese Patent Application No. 201010117783.3 filed on Mar. 2, 2010, the entire contents of which are incorporated herein by reference.

TECHNICAL FIELD OF THE INVENTION

The present invention relates to a brass alloy and manufacturing method thereof, especially to an environment-friendly manganese brass alloy and manufacturing method thereof.

BACKGROUND OF THE INVENTION

Currently, brass alloy has been used for the materials of civil and industrial water supply systems. The brass alloy generally contains 1.0~4.0% lead, which can partially dissolve in the water during the process of water supply, the amount of lead release into water will be in excess of the safety standard (for example, under NSF/ANSI Standard 61-2007-Drinking Water System Components, the release amount of lead should not exceed 5 μg/L, and the release amount of antimony should not exceed 0.6 μg/L). For the past few years, however, the medical experts all over the world found that lead has threatened human health and environment sanitation, accordingly, the researches on substitute for lead brass have been developed in domestic and abroad, wherein mainly three alloy systems are adopted: Cu—Zn—Bi system, Cu—Zn—Si system and Cu—Zn—Sb system.

Bismuth is close to lead in the periodic table of elements. It is brittle and has a lower melting-point than lead, and it cannot form solid solution with brass like lead, therefore, currently, bismuth has been studied more frequently and has been used for actual application as lead-free brass alloy, which has become ideal substitute for lead. Tin and nickel are added into most bismuth brass alloys, even expensive selenium is added into a few bismuth brass alloys, making bismuth distribute into the grain and the grain boundary in the form of particulate instead of distributing into the grain boundary in the form of film, which decreases the hot and cold brittleness of bismuth brass. However, since selenium and bismuth have limited resource and higher prices, the costs of the bismuth brass has been retained at high level. In addition, there are problems of worse castability and weldability, narrower forging temperature scare etc., which make the application and development of bismuth brass restricted to some extent.

In recent years, the study and development of lead-free silicon brass has been turned into the high zinc-low copper brass, i.e., change the form, size and distribution of γ phase in the two phase (β+γ) brass by using modification, improve its processing property and performance. However, the cuttability of such lead-free high zincum silicon brass can only achieve to 70%~80% of HPb59-1.

Chinese patent No. ZL200410015836.5 has disclosed a lead-free free-cutting antimony brass alloy, which is copper-zincum-antimony alloy. Although its cuttability and corrosion resistance have been improved due to the presence of antimony in the alloy, the alloy has not ideal cold processing property, which affects its subsequent processing properties. The relative standard of potable water has strict standards with regard to the amount of Sb, Pb, Cd, As release into water, for example, under NSF/ANSI Standard 61-2007-Drinking Water System Components, the maximum acceptable release amount of Sb is 0.6 μg/L. When the content of Sb are more or equal to 0.2 wt %, the amount of Sb release into water will exceed 0.6 μg/L. This is the most challenge for applying Sb brass alloy into the components such as water tap in the potable water supply system.

Chinese patent No. ZL200710066669.0 has disclosed a high manganese free-cutting copper zinc alloy, and Chinese patent No. ZL 200710066947.2 has disclosed a free-cutting high manganese copper alloy, the manganese is the main alloy element in the above two patents, the differences is the range of manganese content and other alloy elements. As free-cutting high manganese brass alloy, the two alloys have good application prospects. However, the two alloys can not be used as components in the potable water supply system, due to its high Pb content, which results in the excess of Pb maximum acceptable release amount.

At present, lead-free or low lead free-cutting brass, such as high copper silicon brass, high tin-bismuth brass, aluminium brass, antimony brass and so on, can be made into valves using sand casting and punching press methods, when the assembly torque is 90-137 N·m, the concentration of the ammonia water is 14%, and the ammonia fume lasts for 24 hours, only high copper silicon brass and high tin-bismuth brass show good stress corrosion resistance properties. However, such two alloys have high costs, resulting in lacking competitiveness with its products.

SUMMARY OF THE INVENTION

In order to overcome the above drawbacks, the present invention provides an environment-friendly manganese brass alloy with low costs, superior stress corrosion resistance, good dezincification corrosion resistance and mechanical properties and manufacturing method thereof.

One purpose of the present invention is to provide an environment-friendly brass alloy with superior mechanical properties and corrosion resistance, good cold/hot processing properties, castability and cuttability, especially an environment-friendly free-cutting brass alloy, which is suitable for casting and forging and has relative lower costs. Another purpose of the present invention is to provide a manufacturing method of the above-mentioned manganese brass alloy.

In one aspect, the present invention provides an environment-friendly manganese brass alloy comprising: 55~65 wt % of Cu, 1.0~6.5 wt % of Mn, 0.2~3.0 wt % of Al, 0~3.0 wt % of Fe, 0.3~2.0 wt % of Sn, 0.01~0.3 wt % of Mg, 0~0.3 wt % of Bi and/or 0~0.2 wt % of Pb, the balance being Zn and unavoidable impurities.

Preferably, the content of Mn in the manganese brass alloy is 2.0~5.0 wt %, preferably is 2.5~4.5 wt %, more preferably is 3.5~4.5 wt %.

Preferably, the content of Al in the manganese brass alloy is 0.4~2.5 wt %, preferably is 0.6~2.0 wt %, more preferably is 0.6~1.5 wt %.

Preferably, the content of Fe in the manganese brass alloy is 0~1.8 wt %, preferably is 0~0.8 wt %.

Preferably, the content of Sn in the manganese brass alloy is 0.3~1.5 wt %, preferably is 0.5~1.3 wt %, more preferably is 0.8~1.0 wt %.

Preferably, the content of Mg in the manganese brass alloy is 0.01~0.2 wt %, preferably is 0.05~0.15 wt %, more preferably is 0.07~0.1 wt %.

Preferably, the content of Bi in the manganese brass alloy is 0~0.25 wt %, preferably is 0~0.15 wt %.

Preferably, the content of Pb in the manganese brass alloy is 0~0.15 wt %, preferably is 0~0.1 wt %.

In another aspect, the present invention provides a method for manufacturing the above-mentioned manganese brass alloy, which comprises: batching, melting, pouring alloy ingots, remelting, sand casting or low pressure casting, wherein the temperature for pouring alloy ingots is 980~1030° C., the temperature for sand casting is 1000~1030° C., and the temperature for low pressure casting is 970~1000° C.

In still another aspect, the present invention provides a method for manufacturing the above-mentioned manganese brass alloy, which comprises: batching, melting, horizontal continuous casting round ingots, flaying, extruding into bars and hot forging, wherein the temperature for horizontal continuous casting is 980~1030° C., the temperature for extruding is 660~750° C., and the temperature for hot forging is 660~750° C.

In still yet another aspect, the present invention provides a method for manufacturing the above-mentioned manganese brass alloy, which comprises: batching, melting, horizontal continuous casting round ingots, flaying and hot forging, wherein the temperature for horizontal continuous casting is 980~1030° C., and the temperature for hot forging is 660~750° C.

DETAILED DESCRIPTION OF THE INVENTION

In order that the present invention may be more fully understood, it will now be described detailedly as follows.

In order to solve the problems of insufficient performance for the existing lead-containing or lead-free free-cutting brass alloy, the present invention provides the technical solution as follows: an environment-friendly low cost manganese brass alloy comprising: 55~65 wt % of Cu, 1.0~6.5 wt % of Mn, 0.2~3.0 wt % of Al, 0~3.0 wt % of Fe, 0.3~2.0 wt % of Sn, 0.01~0.3 wt % of Mg, 0~0.3 wt % of Bi and/or 0~0.2 wt % of Pb, the balance being Zn and unavoidable impurities.

According to one embodiment of the present invention, the environment-friendly manganese brass alloy of the present invention comprises: 55~60 wt % of Cu, 2.0~6.0 wt % of Mn, 0.4~2.0 wt % of Al, 0.4~1.5 wt % of Sn, 0~2.0 wt % of Fe, 0.01~0.1 wt % of Mg, 0.15~0.2 wt % of Pb, the balance being Zn and unavoidable impurities.

According to another embodiment of the prensent invention, the environment-friendly manganese brass alloy of the present invention comprises: 61~63 wt % of Cu, 3.0~5.5 wt % of Mn, 1.5~2.5 wt % of Al, 1.0~1.2 wt % of Sn, 0.5~1.5 wt % of Fe, 0.05~0.15 wt % of Mg, 0.1~0.3 wt % of Bi, the balance being Zn and unavoidable impurities.

According to still another embodiment of the present invention, the environment-friendly manganese brass alloy of the present invention comprises: 62~65 wt % of Cu, 5.0~6.5 wt % of Mn, 1.0~1.5 wt % of Al, 0.4~0.8 wt % of Sn, 0.05~0.2 wt % of Mg, 0.1~0.3 we/0 of Bi and/or 0.1~0.2 we/0 of Pb, the balance being Zn and unavoidable impurities.

The addition of manganese into brass alloys according to the present invention may increase the strength and hardness of the alloys through solid solution strengthening, thus can effectively improve the cuttability of the brass alloys, and magnificently raise its corrosion resistance to seawater, chloride and superheated vapor. Manganese may stabilize β phase of the brass containing Al, relieve the precipitation action of γ phase induced by Al. The coefficient of zinc equivalent of manganese is 0.5, which may enlarge the area of β phase, however, it has not obvious effect, in contrast, under the conditions that the amount of copper and other elements are fixed, the addition of manganese can reduce the content of zinc, thus enlarge the area of α phase, therefore, controlling a suitable proportion of the content of manganese and zinc can increase the α phase-ratio, accordingly can improve the corrosion resistance of the alloy, especially improve the stress corrosion resistance properties of the alloy. Manganese and iron can form solid solution, and manganese also can solutionize in copper with great amount, therefore, more Fe can solutionize in copper matrix along with Mn. It is Mn that increases the solid solubility of the Fe in α phase, thereby may improve the strengthening of Fe in the brass and inhibit the segregation of the Fe, and can improve the stress corrosion resistance properties of the alloy with combination of Fe. When low amount of manganese is added into the brass, there will be no magnificent effect, when too much amount of manganese is added into the brass, the hardness (HRB) of the alloy will exceed 80, increasing the cutting resistance and decreasing the cutting efficiency, therefore, the it is suitable to control the amount of manganese in the range of 1.0~6.5 wt %.

Aluminium, as one of main alloy elements, is mainly used for solutionizing strengthening, increasing hot crack resistant properties and deoxidation, it also can be used to increase the fluidity of the alloy in favor of the moulding of casts. Al can form $Al_2O_3$ film in the surface of the casts, therefore can improve its corrosion resistance properties. Under the conditions that manganese is added, its content should be controlled in the range of 0.2~3.0 wt %. When low content of aluminum is used, it is disadvantageous to perform the beneficial effect; when too much amount of aluminium is used, the fluidity of the alloy will be reduced because the Al tends to form oxidized sediments, which is disadantageous to the casting and welding properties.

The iron has extremely low solid solubility in brass, its iron-rich particles may fine the cast structure and inhibit the grain growth for recrystallization. It is better to add iron with manganese, aluminium, tin and so forth at the same time, however, for the casted and forged water tap body which needs to be polished and electroplated, no iron or low amount of iron should be added, otherwise, the segregation of the iron-rich phase will occur, and hard spots will be produced, which will adversely affect the quality of electro-deposition surface. For those products which do not need to be polished and electroplated, middle or high amount of Fe can be used, however, when too high amount of Fe is used, the plasticity of the alloy and the corrosion resistance of the brass will be reduced, therefore, the amount of iron should be controlled in the range of 0~3.0 wt %.

The main action of tin is to inhibit the dezincification of the brass, and to enhance its corrosion resistance, especially to enhance the stess corrosion resistance properties. Small amount of Sn can increase the hardness and strength of the brass, however, if the content of Sn exceeds 2.0 wt %, on the contrary, the properties of the brass will be reduced. Furthermore, the price of Sn is high, the higher the content of Sn is, the higher the cost of the alloy is, therefore, the content of tin should be controlled in the range of 0.3~2.0 wt %.

The addition of magnesium is mainly used for deoxidization, desulfuration and grain fining, as well as improving the dezincification corrosion resistance properties of the alloy and mechanical properties. However, the effect of dezincification corrosion resistance and casting properties is reduced with the increase of the content of magnesium, it is suitable to use 0.01~0.3 wt % of Mg, and lower content of Mg has no obvious effect.

Alternatively, Bi and/or Pb will be added to further ensure the cutability of the alloy. The content of Bi should be controlled in the range of 0~0.3 wt %, the costs of feedstock will be increased if the content of Bi is too high; the content of Pb should be controlled in the range of 0~0.2 wt %, the release amount of Pb will exceed the standard if the content of Pb is too high.

The present invention provides a method of manufacturing the above-mentioned brass, which comprises: batching, melting, pouring alloy ingots, remelting, sand casting or low pressure casting, wherein the temperature for pouring alloy ingots is 980~1030° C., the temperature for sand casting is 1000~1030° C., and the temperature for low pressure casting is 970~1000° C.

The present invention provides another method of manufacturing the above-mentioned brass, which comprises: batching, melting, horizontal continuous casting round ingots, flaying, extruding into bars and hot forging, wherein the temperature for horizontal continuous casting is 980~1030° C., the temperature for extruding is 660~750° C., and the temperature for hot forging is 660~750° C.

The present invention provides still another method of manufacturing the above-mentioned brass, which comprises: batching, melting, horizontal continuous casting round ingots, flaying and hot forging, wherein the temperature for horizontal continuous casting is 980~1030° C., and the temperature for hot forging is 660~750° C.

FIG. 1 shows a process chart of manufacturing the above-mentioned brass alloy according to the present invention.

Comparing to prior art, the present invention at least contains the following beneficial effects: the present invention has obtained a brass alloy with superior mechanical properties, castability, cutability and corrosion resistance, especially with stress corrosion resistance properties, by the addition of manganese. On condition that the assemble stress can not be eliminated by anneal, and in the environment of ammonia water with concentration considerably higher than the national standard of 14%, the alloy does not display stress corrosion cracking phenomenon under ammonia fume for 24 hours.

The brass alloy of the present invention contains lower content of tin and bismuth, and does not contain nickel etc. The feedstocks have low cost, therefore, the brass alloys manufactured also have low cost.

The brass alloy of the present invention does not contain lead or only contains low content of lead, therefore, it belongs to environment-friendly alloy. Such alloy reduces harm to human body and environment due to lead. At the same time, the metal release amount of the alloy into water meets the NSF/ANSI61-2007 standard.

The manufacturing process of the present invention is simple, and can be performed with existing equipments for lead brass.

The manganese brass alloy of the present invention has superior mechanical properties, castability, cutability and corrosion resistance, especially stress corrosion resistance properties, is an environment-friendly free-cutting brass alloy, and suitable for casting and forging and has low costs.

BRIEF DESCRIPTION OF DRAWING

FIG. 1 shows a process chart for manufacturing the brass alloy according to the present invention.

DETAILED DESCRIPTION OF PREFERRED EMBODIMENTS

The present invention will be further described detailedly with the combination of the drawing and embodiments.

EXAMPLES

Table 1 shows the compositions of the brass alloys according to the examples of the present invention and the alloys used for comparison, wherein the alloys 1-6 are produced by sand casting, and the manufacturing process is demonstrated in FIG. 1; and the alloys 7-12 are produced by horizontal continuous casting round ingots and hot forge moulding, and the manufacturing process is demonstrated in FIG. 1. The alloy ZCuZn40Pb2 is bought for comprison.

TABLE 1 the compositions (wt %) of the brass alloys according to the examples of the present invention and the alloys used for comparison

| Alloys | Cu | Mn | Al | Fe | Ti | Sn | Si | Cr | Mg | Bi | Pb | Zn |
|---|---|---|---|---|---|---|---|---|---|---|---|---|
| 1 | 55.43 | 1.16 | 0.95 | — | — | 1.12 | — | — | 0.18 | 0.14 | — | Balance |
| 2 | 57.31 | 3.50 | 0.67 | 0.76 | — | 0.36 | — | — | 0.12 | 0.22 | — | Balance |
| 3 | 58.69 | 4.78 | 2.50 | — | — | 1.85 | — | — | 0.09 | — | — | Balance |
| 4 | 60.56 | 5.02 | 1.12 | — | — | 0.75 | — | — | 0.09 | 0.11 | — | Balance |
| 5 | 61.58 | 2.44 | 0.46 | 2.58 | — | 0.44 | — | — | 0.26 | — | 0.14 | Balance |
| 6 | 59.35 | 5.52 | 1.32 | — | — | 0.96 | — | — | 0.15 | 0.30 | — | Balance |
| 7 | 62.40 | 3.48 | 2.27 | 0.73 | — | 1.29 | — | — | 0.07 | — | 0.18 | Balance |
| 8 | 63.99 | 6.37 | 0.95 | — | — | 0.56 | — | — | 0.23 | 0.29 | — | Balance |
| 9 | 63.25 | 4.55 | 1.80 | — | — | 0.90 | — | — | 0.18 | 0.15 | 0.10 | Balance |
| 10 | 64.40 | 6.46 | 1.69 | 1.73 | — | 0.86 | — | — | 0.07 | 0.23 | 0.15 | Balance |
| 11 | 62.35 | 5.97 | 0.66 | 0.63 | — | 0.77 | — | — | 0.05 | — | — | Balance |
| 12 | 63.50 | 0.70 | 0.18 | — | 0.03 | 0.60 | 0.12 | 0.10 | — | — | — | Balance |
| ZCuZn40Pb2 | 60.57 | — | 0.53 | 0.02 | — | — | — | — | — | — | 2.05 | Balance |

The property testing of the alloys listed above are performed below. The testing results are as follows:

1. Mechanical Properties

Alloys 1-6 are prepared by sand casting; alloys 7-12 are prepared by horizontal continuous casting; the comparative alloy is lead brass ZCuZn40Pb2 (alloy ZCuZn40Pb2 is available from Zhejiang Ke-yu metal materials Co., Ltd.), which is produced by sand casting, with a diameter of 29 mm, and machined into the samples with a diameter of 10 mm. The tensile test is performed under the room temperature. The results are shown in table 2.

2. Dezincification Test

The dezincification test is conducted according to GB/T 10119-2008. The comparative sample is lead brass ZCuZn40Pb2 (alloy ZCuZn40Pb2 is available from Zhejiang Ke-yu metal materials Co., Ltd.), which is prepared by casting. The measured maximum dezincification depths are shown in table 2.

TABLE 2

Dezincification corrosion resistance, cuttability and mechanical properties of the test samples

| Alloys | | 1 | 2 | 3 | 4 | 5 | 6 | 7 | 8 | 9 | 10 | 11 | 12 | ZCuZn40Pb2 |
|---|---|---|---|---|---|---|---|---|---|---|---|---|---|---|
| Mechanical properties | Tensile strength | 396 | 423 | 440 | 465 | 457 | 481 | 448 | 490 | 475 | 480 | 445 | 421 | 385 |
| | Expansion ratio/% | 10.5 | 14 | 18.5 | 21.5 | 31.5 | 27 | 46.5 | 22 | 25.5 | 26 | 29.5 | 19 | 18.5 |
| | Hardness/HRB | 73 | 65 | 76 | 74 | 78 | 80 | 73 | 85 | 82 | 78 | 75 | 68 | 65 |
| Maximum depths of dezincification layer/μm | | 365 | 464 | 371 | 340 | 320 | 347 | 322 | 290 | 310 | 329 | 340 | 680 | 690 |
| Cutting resistance/N | | 440 | 429 | 436 | 466 | 471 | 459 | 475 | 460 | 470 | 475 | 469 | 505 | 373 |
| Relative cutting ratio/% | | | >85 | | | | | >80 | | | | | 74 | 100 |

It has been known that the higher the depth of dezincification layer of the alloy is, the worse the dezincification corrosion resistance properties of the alloy is. Table 2 shows that the dezincification corrosion resistance properties of the alloys according to the present invention surpasses that of the lead brass ZCuZn40Pb2.

3. Cuttability

The test samples are prepared by casting, and the same cutter, cutting time and feeding amount are used. The cutter model: VCGT160404-AK H01 (KORLOY COMPANY in Korea), the rotational speed: 570 r/min, the feeding rate: 0.2 mm/r, the back engagement: 2 mm on one side. The universal dynamometer for broaching, hobbing, drilling and grinding developed by Beijing University of Aeronautics and Astronautics is used for measuring the cut resistance of ZCuZn40Pb2 and the brass alloys according to the invention respectively. Calculate the relative cutting ratio and then the results are shown in table 2.

The calculating formula of relative cutting ratio is as follows:

$$\frac{\text{cutting resistance of ZCuZn40Pb2}}{\text{cutting resistance of alloys 1-12}} \times 100\%$$

4. Castability

The castability of alloys 1-6 and alloy ZCuZn40Pb2 (alloy ZCuZn40Pb2 is available from Zhejiang Ke-yu metal materials Co., Ltd.) listed in table 1 is measured by four kinds of common standard test samples for casting alloys. Volume shrinkage samples are used for measuring the concentrating shrinkage cavity, dispersing shrinkage cavity and shrinkage porosity. Spiral samples are used for measuring the melt fluid length and evaluating the fluidity of the alloy. Strip samples are used for measuring linear shrinkage rate and bending resistance (bending angle) of the alloys. Circular samples with different thicknesses are used for measuring shrinkage crack resistance of the alloys. If the face of the concentrating shrinkage cavity for volume shrinkage test samples is smooth, there is no visible shrinkage porosity in the bottom of the concentrating shrinkage cavity, and there is no visible dispersing shrinkage cavity in the test samples' cross section, it indicates the castability is excellent, and will be shown as "○". If the face of the concentrating shrinkage cavity is smooth but the height of visible shrinkage porosity is less than 5 mm in depth, it indicates castability is good, and will be shown as "Δ". If the face of the concentrating shrinkage cavity is not smooth and the height of visible shrinkage porosity is more than 5 mm in depth, it will be shown as "x". If there is visible crack in the casting face or the polishing face of the test samples, it is rated as poor, and will be shown as "x", and if there is no crack, it is rated as excellent, and will be shown as "○". The results are shown in table 3.

TABLE 3

Castability of the test samples

| alloys | | 1 | 2 | 3 | 4 | 5 | 6 | ZCuZn40Pb2 |
|---|---|---|---|---|---|---|---|---|
| Volume shrinkage | | ○ | ○ | ○ | ○ | ○ | ○ | ○ |
| Fluid length/mm | | 420 | 460 | 465 | 455 | 480 | 475 | 410 |
| Linear shrinkage/% | | 1.6 | 1.63 | 1.47 | 1.45 | 1.35 | 1.7 | 2.1 |
| Bending angle/° | | | | >90 | | | | 80 |
| Circular samples | 2.0 mm | ○ | ○ | ○ | ○ | ○ | ○ | ○ |
| | 3.5 mm | ○ | ○ | ○ | ○ | ○ | ○ | ○ |
| | 4.0 mm | ○ | ○ | ○ | ○ | ○ | ○ | ○ |

5. Stress Corrosion Resistance

Alloys 1-12 and alloy ZCuZn40Pb2 are respectively produced into ½ inch and 1 inch ball valves including unassembled and assembled products (with a fastening torque of 90 N·m), wherein the assembled products include the unloading external pipes and the external pipes with a load torque. The ½ inch ball valves are exerted for torque of 90 N·m, and 1 inch ball valves for torque of 137 N·m. The above-mentioned alloy samples are kept respectively in 8% ammonia, 14% ammonia at temperature of 25° C. for 24 hours. After fumed with ammonia according to two standards, the test samples are taken out, and washed clean, the corrosion products on the surface of which are then rinsed with 5% sulfuric acid solution under the room temperature, and finally rinsed with water and blow-dried. The surfaces fumed with ammonia are observed at 10× magnification. If there is no obvious crack on the surface, it will be shown as "○", if there is fine crack on the surface, it will be shown as "Δ", and if there is obvious crack on the surface, it will be shown as "x".

TABLE 4

| Stress corrosion resistance of the test samples | | | | | | | | |
|---|---|---|---|---|---|---|---|---|
| | 8% ammonia/24 h | | | | 14% ammonia/24 h | | | |
| | | Assembled products (torque) | | | | Assembled products (torque) | | |
| alloys | Unassembled | Unloaded | 90N · m | 137N · m | Unassembled | Unloaded | 90N · m | 137N · m |
| 1 | ○ | ○ | ○ | ○ | ○ | ○ | ○ | ○ |
| 2 | ○ | ○ | ○ | ○ | ○ | ○ | ○ | ○ |
| 3 | ○ | ○ | ○ | ○ | ○ | ○ | ○ | ○ |
| 4 | ○ | ○ | ○ | ○ | ○ | ○ | ○ | ○ |
| 5 | ○ | ○ | ○ | Δ | ○ | ○ | ○ | ○ |
| 6 | ○ | ○ | ○ | ○ | ○ | ○ | ○ | Δ |
| 7 | ○ | ○ | ○ | ○ | ○ | ○ | Δ | ○ |
| 8 | ○ | ○ | ○ | ○ | ○ | ○ | ○ | ○ |
| 9 | ○ | ○ | ○ | Δ | ○ | ○ | Δ | x |
| 10 | ○ | ○ | ○ | ○ | ○ | ○ | ○ | ○ |
| 11 | ○ | ○ | ○ | ○ | ○ | ○ | Δ | Δ |
| 12 | ○ | ○ | ○ | x | ○ | ○ | x | x |
| ZCuZn40Pb2 | ○ | ○ | Δ | x | ○ | ○ | x | x |

As shown in table 4, after the ammonia fume, the stress corrosion resistance properties of the alloys according to the present invention obviously surpass that of the alloy ZCuZn40Pb2.

6. Metal Ions Release into Water

The test of metal release amount of alloys 1-12 has been performed according to NSF/ANSI61-2007 standard with a 19 days testing time, the test results meet all the requirements of the standard.

What is claimed is:

1. An environment-friendly manganese brass alloy consisting of: 55-65 wt % of Cu, 1.0-6.5 wt % of Mn, 0.2-3.0 wt % of Al, 0-3.0 wt % of Fe, 0.8-1.0 wt % of Sn, 0.01-0.3 wt % of Mg, 0-0.3 wt % of Bi and/or 0-0.2 wt % of Pb, the balance being Zn and unavoidable impurities.

2. The environment-friendly manganese brass alloy according to claim 1, wherein the content of Mn in the manganese brass alloy is 2.0-5.0 wt %.

3. The environment-friendly manganese brass alloy according to claim 2, wherein the content of Mn in the manganese brass alloy is 2.5-4.5 wt %.

4. The environment-friendly manganese brass alloy according to claim 3, wherein the content of Mn in the manganese brass alloy is 3.5-4.5 wt %.

5. The environment-friendly manganese brass alloy according to claim 1, wherein the content of Al in the manganese brass alloy is 0.4-2.5 wt %.

6. The environment-friendly manganese brass alloy according to claim 5, wherein the content of Al in the manganese brass alloy is 0.6-2.0 wt %.

7. The environment-friendly manganese brass alloy according to claim 6, wherein the content of Al in the manganese brass alloy is 0.6-1.5 wt %.

8. The environment-friendly manganese brass alloy according to claim 1, wherein the content of Fe in the manganese brass alloy is 0-1.8 wt %.

9. The environment-friendly manganese brass alloy according to claim 8, wherein the content of Fe in the manganese brass alloy is 0-0.8 wt %.

10. The environment-friendly manganese brass alloy according to claim 1, wherein the content of Mg in the manganese brass alloy is 0.01-0.2 wt %.

11. The environment-friendly manganese brass alloy according to claim 10, wherein the content of Mg in the manganese brass alloy is 0.05-0.15 wt %.

12. The environment-friendly manganese brass alloy according to claim 11, wherein the content of Mg in the manganese brass alloy is 0.07-0.1 wt %.

13. The environment-friendly manganese brass alloy according to claim 1, wherein the content of Bi in the manganese brass alloy is 0-0.25 wt %.

14. The environment-friendly manganese brass alloy according to claim 13, wherein the content of Bi in the manganese brass alloy is 0-0.15 wt %.

15. The environment-friendly manganese brass alloy according to claim 1, wherein the content of Pb in the manganese brass alloy is 0-0.15 wt %.

16. The environment-friendly manganese brass alloy according to claim 15, wherein the content of Pb in the manganese brass alloy is 0-0.1 wt %.

17. A method for manufacturing the manganese brass alloy according to claim 1, the method comprising: batching, melting, pouring alloy ingots, remelting, sand casting or low pressure casting, wherein the temperature for pouring alloy ingots is 980-1030° C., the temperature for sand casting is 1000-1030° C., and the temperature for low pressure casting is 970-1000° C.

18. A method for manufacturing the manganese brass alloy according to claim 1, the method comprising: batching, melting, horizontal continuous casting round ingots, flaying, extruding into bars and hot forging, wherein the temperature for horizontal continuous casting is 980-1030° C., the temperature for extruding is 660-750° C., and the temperature for hot forging is 660-750° C.

19. A method for manufacturing the manganese brass alloy according to claim 1, the method comprising: batching, melting, horizontal continuous casting round ingots, flaying and hot forging, wherein the temperature for horizontal continuous casting is 980-1030° C., and the temperature for hot forging is 660-750° C.

* * * * *